US007686135B2

(12) United States Patent
Lee

(10) Patent No.: US 7,686,135 B2
(45) Date of Patent: Mar. 30, 2010

(54) ESCAPE DEVICE

(76) Inventor: Terry Victor Lee, 2/9-11 Ewos Parade, Cronulla, New South Wales, 2230 (AU)

( * ) Notice: Subject to any disclaimer, the term of this patent is extended or adjusted under 35 U.S.C. 154(b) by 911 days.

(21) Appl. No.: 10/531,771

(22) PCT Filed: Sep. 3, 2003

(86) PCT No.: PCT/AU03/01132

§ 371 (c)(1),
(2), (4) Date: Oct. 3, 2005

(87) PCT Pub. No.: WO2004/037348

PCT Pub. Date: May 6, 2004

(65) Prior Publication Data

US 2006/0096807 A1 May 11, 2006

(30) Foreign Application Priority Data

Oct. 25, 2002 (AU) ..... 2002952251

(51) Int. Cl.
*A62B 1/10* (2006.01)

(52) U.S. Cl. ..... 182/234; 182/239

(58) Field of Classification Search ..... 182/234, 182/239

See application file for complete search history.

(56) References Cited

U.S. PATENT DOCUMENTS

| | | | | | |
|---|---|---|---|---|---|
| 4,457,400 | A | * | 7/1984 | Donaldson et al. | 182/234 |
| 4,623,038 | A | | 11/1986 | Stancato | |
| 4,646,885 | A | * | 3/1987 | Giardini | 188/325 |
| 4,722,422 | A | * | 2/1988 | Hiraoka | 182/233 |
| 4,729,454 | A | * | 3/1988 | Barelli et al. | 182/234 |
| 5,076,395 | A | * | 12/1991 | Kikuchi | 182/234 |

FOREIGN PATENT DOCUMENTS

| | | |
|---|---|---|
| DE | 25 28 410 | 1/1977 |
| FR | 2 278 354 | 2/1976 |
| GB | 2 306 107 | 4/1997 |
| SU | 1243740 | 7/1986 |

* cited by examiner

*Primary Examiner*—Alvin C Chin-Shue
(74) *Attorney, Agent, or Firm*—Sand & Sebolt

(57) ABSTRACT

An escape device (10) including a cable (18), a rotatable cable dispensing assembly (22) from which the cable (18) is dispensed under load, a braking mechanism (28) operatively connected to the rotatable cable dispensing assembly (22), whereby a braking response of the braking mechanism (18) is proportional to the rate at which cable (18) is dispensed from the rotatable cable dispensing assembly (22).

19 Claims, 15 Drawing Sheets

ESCAPE DEVICE

FIELD OF THE INVENTION

The present invention relates to an escape device. The device of the present invention is directed to a device that enables escape from high-rise buildings.

BACKGROUND OF THE INVENTION

In emergencies evacuation from multi-story buildings is problematic. Specifically, where a situation, for example, a fire occurs in a lower floor people on upper floors may be trapped. In such situations use of elevators is generally not recommended and, where interruptions to power supply occur, is not possible. Many modern buildings are constructed so as to include fireproof floors at some levels. However, public confidence in the ability of fire proofing systems is not high. Further, it has become apparent that there are emergency situations that may arise as a result of deliberate sabotage in which the structural integrity of the building is compromised. In such situations fast escape from the building may be required for large numbers of personnel in a short space of time to avoid injury and fatality on a large scale as a building collapses.

Some prior art devices for escape from buildings are known.

In some buildings the exterior of the building may be designed or modified to incorporate exterior escape routes or emergency evacuation equipment. This approach is not suitable for use in very high buildings, nor is the approach suitable for the escape of the large numbers of people that may need to leave a building at any one time.

Portable escape devices are also known. Some of these devices have the advantage that any one individual may acquire and carry their own device for emergency situations. This obviously provides the individual with his or her own personal escape device, which is psychologically reassuring. However, these devices frequently operate on the basis of a friction brake with a simple on/off mechanism that causes jarring in use and, as such they are not suitable for traversing the distances needed to be travelled to reach ground level safely from many modern buildings. For example, the construction of the devices may be such that they would conceivably be very bulky if constructed for use in higher buildings, or the heat generated during their use would make them impractical. For this reason existing portable escape and descent devices are perhaps providing illusory reassurance to their owners.

It is to this situation that the present invention is addressed. A portable escape device is provided that allows the user to travel many floor levels.

SUMMARY OF THE INVENTION

Therefore, according to a first aspect of the invention there is provided an escape device characterized in that it includes:

a cable;

a rotatable cable dispensing assembly from which said cable is dispensed under load, a braking mechanism operatively connected to said rotatable cable dispensing assembly;

whereby a braking response of the braking mechanism is proportional to the rate at which cable is dispensed from the rotatable cable dispensing assembly.

By producing a braking effect responsive to the speed of the device it is possible to have a regulated a smoother descent.

Preferably, the cable dispensing assembly and the braking mechanism are located in an outer housing.

Usefully, a housing will also include cooling leaf members adapted to allow air flow there through to thereby dissipate any heat generated by the device. It can be appreciated that during descent the device may generate heat. A self cooling operation is preferable.

It is also preferable if the housing incorporates guides to locate the position of cable dispensed from the device.

Conveniently, the device includes a back plate mounted thereto said back plate adapted to be strapped to a back of a person to thereby secure said person to said device. A simple harness makes the device easy to carry and deploy.

Preferably, the braking mechanism is operatively connected to said cable dispensing assembly through an output shaft driven by the cable dispensing assembly and wherein said braking mechanism is a centrifugal braking mechanism in which a brake spinner frame having one or more braking elements attached thereto is connected to the output shaft and is rotated in response to rotation of the output shaft.

Preferably, the braking frame includes one or more braking elements pivotally mounted thereto, said braking elements pivoting under the influence of centrifugal force as the output shaft rotates to thereby bring the braking elements progressively into contact with a braking surface. More preferably, the braking elements are biased into a braking position whereby at least some braking force is applied when the device is at rest.

The braking mechanism may be operatively connected to said cable dispensing assembly through a geared arrangement. The use of a geared arrangement allows the device to have a more responsive braking system.

The device of the invention therefore uses the forces acting on the cable as it is paid out from the device to drive the gearing arrangement. The gearing arrangement then serves to accelerate to the speed of rotation such that the output from the gearing is then able to produce a substantial braking effect.

Preferably, the rotatable dispensing assembly includes a reel from which said cable is dispensed has an innermost surface serving as a ring gear of a planetary gear mechanism and the ring gear operates through a gear drives output shaft, said output shaft serving to operate said braking mechanism. The planetary gear arrangement consists of three outermost planetary gears carried on a stationary gear frame are arranged around a central spinner gear and wherein the spinner gear independently engages all three planetary gears, whereby each planetary gear engages ring gear such that dispensing of cable drives the ring gear which, in turn drives the planetary gears and thus the spinner gear.

Preferably, the spinner gear is secured for rotation on a spinner gear shaft, and whereby the spinner gear shaft is also connected to the braking mechanism such that a speed of rotation of the spinner gear and thereby the is proportional to a speed of rotation of the ring and thus the a braking response of the braking mechanism is proportional to the rate at which cable is dispensed from the cable dispensing assembly.

Preferably, the cable is adapted to be connected at a free end thereof to a launch arm attached to a building. A launch arm may consist of a channel member having a track therein adapted to hold a runner attached to a free end of the cable. By attaching the device to a building in this way the user is able to position themselves clear on any obstructions on the descent.

Preferably, the launch arm is movable between a retracted position in which the channel is inoperative an extended condition in which the launch arm is available for use a safety flap serving to restrict access to said channel in the retracted position and said safety flap being released as said channel is moved to an extended position.

DESCRIPTION OF DRAWINGS

The above and other objects, features, and advantages of the present invention will be apparent from the following detailed description of a preferred embodiment in conjunction with the accompanying drawings. In the drawings.

DESCRIPTION OF THE PREFERRED EMBODIMENT

Figure 1:
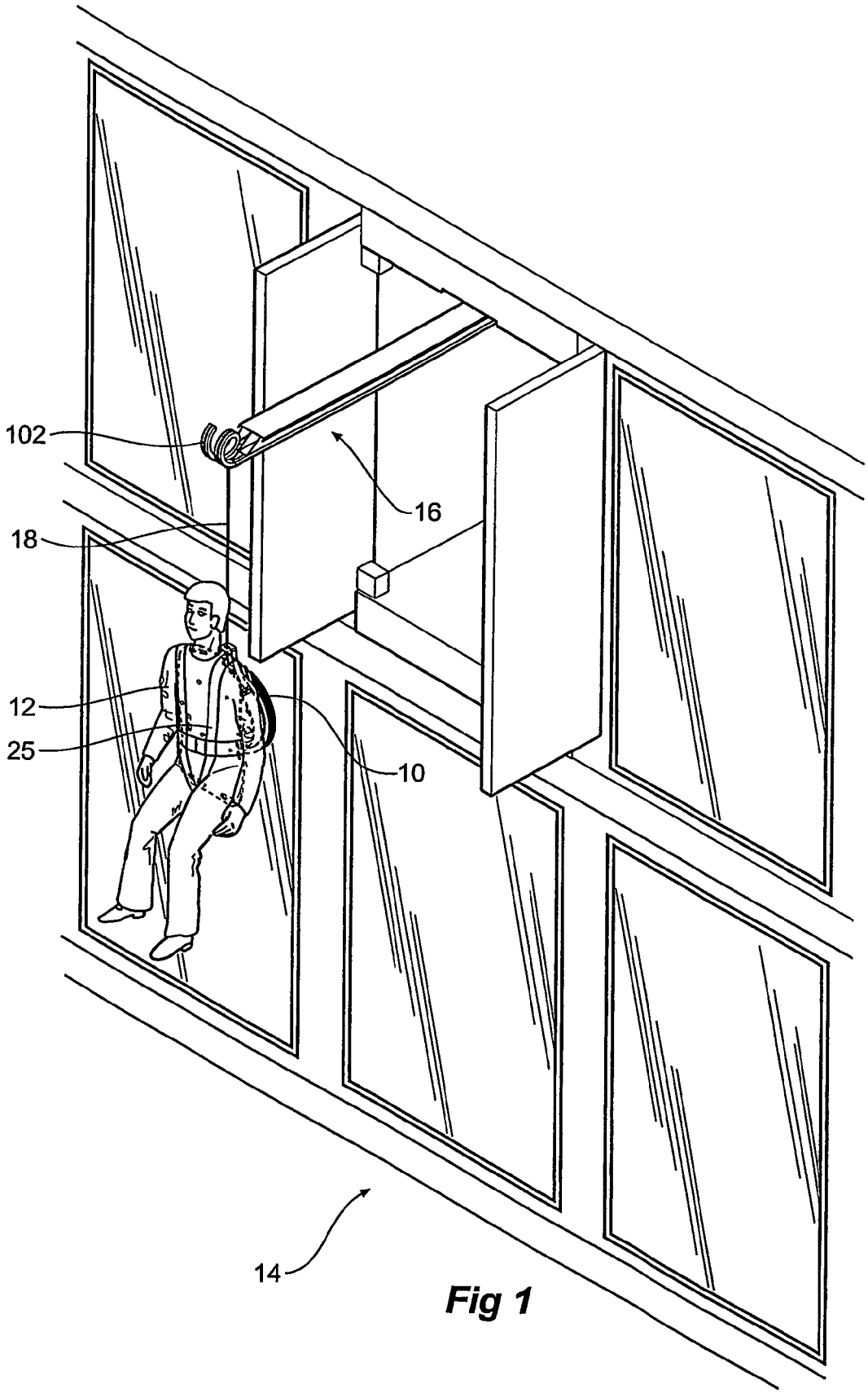
FIG. 1 illustrates an escape device in accordance with the present invention.

The drawings illustrate the various components of an escape device 10 constructed in accordance with the present invention. The device 10 is designed for rapid deployment and may be used to evacuate large numbers of personnel 12 from modern multi-story buildings 14 in a short space of time. The device 10 is designed to be used in conjunction with a launch arm building attachment 16, which can be seen more clearly in FIGS. 21 to 23. In use it is anticipated that a unit 10 may be individually owned and carried from building to building as required by the owner 12, or, alternatively that a number of units 10 may be held in any one building for use by the occupants as and when the need arises.

FIG. 1 illustrates the escape device 10 in use by a person 12 descending from an elevated level of a building 14. The person 12 is suspended from an attachment 16 to which the unit is connected via a cable 18 so that he or she may descend the outside of the building 14 until safely on the ground. The mechanism for enabling this descent is contained within the unit 10 and will be described herein. The cable 18 is composed of monofilament having a breaking strain of 600 Kg at 900° C. Alternatively, other wire material may be used that has substantial strength at higher temperatures, for example Swedish piano wire.

Figure 2:
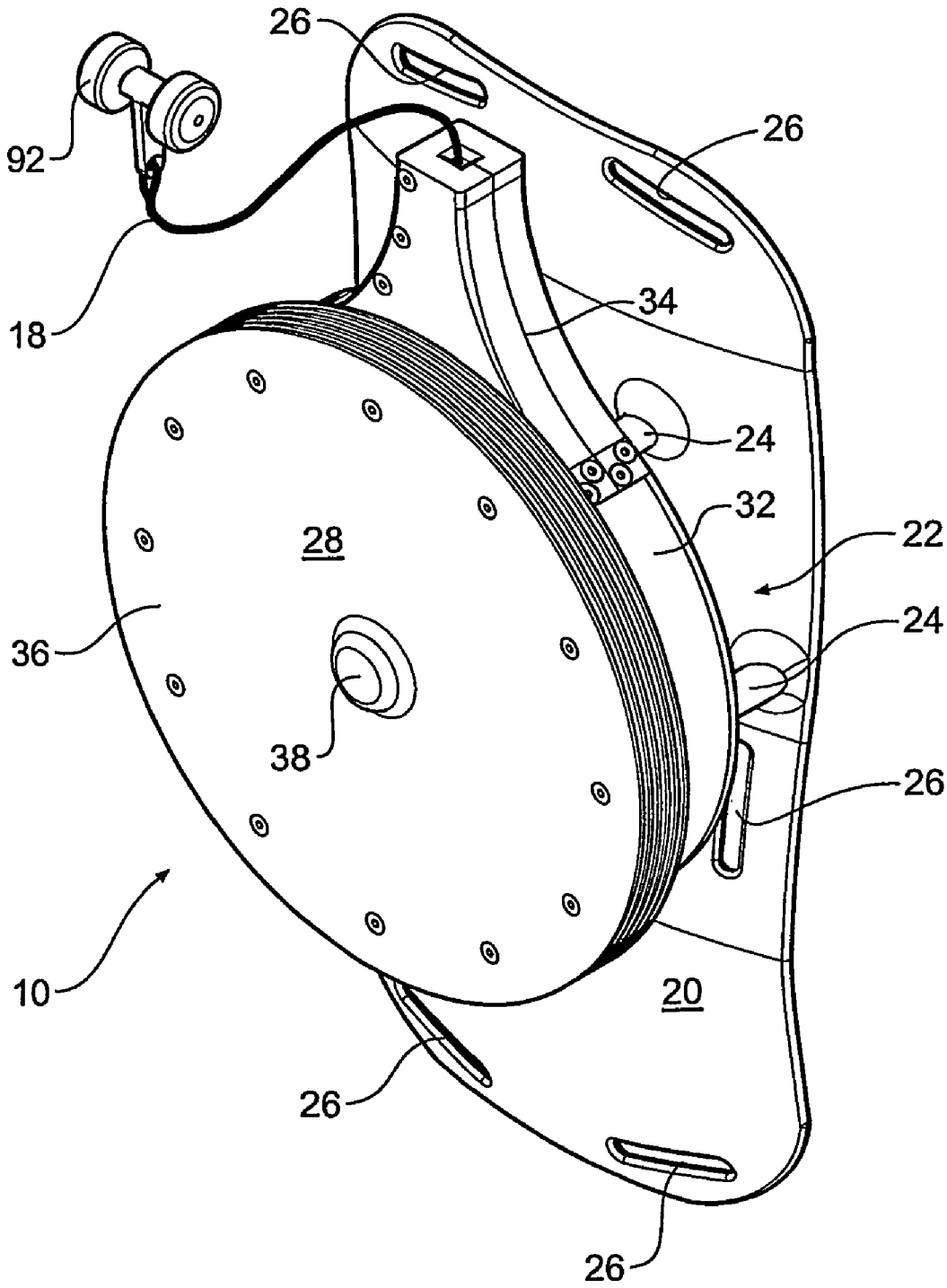
FIG. 2 illustrates a perspective view of the escape device of FIG. 1.
Figure 3:
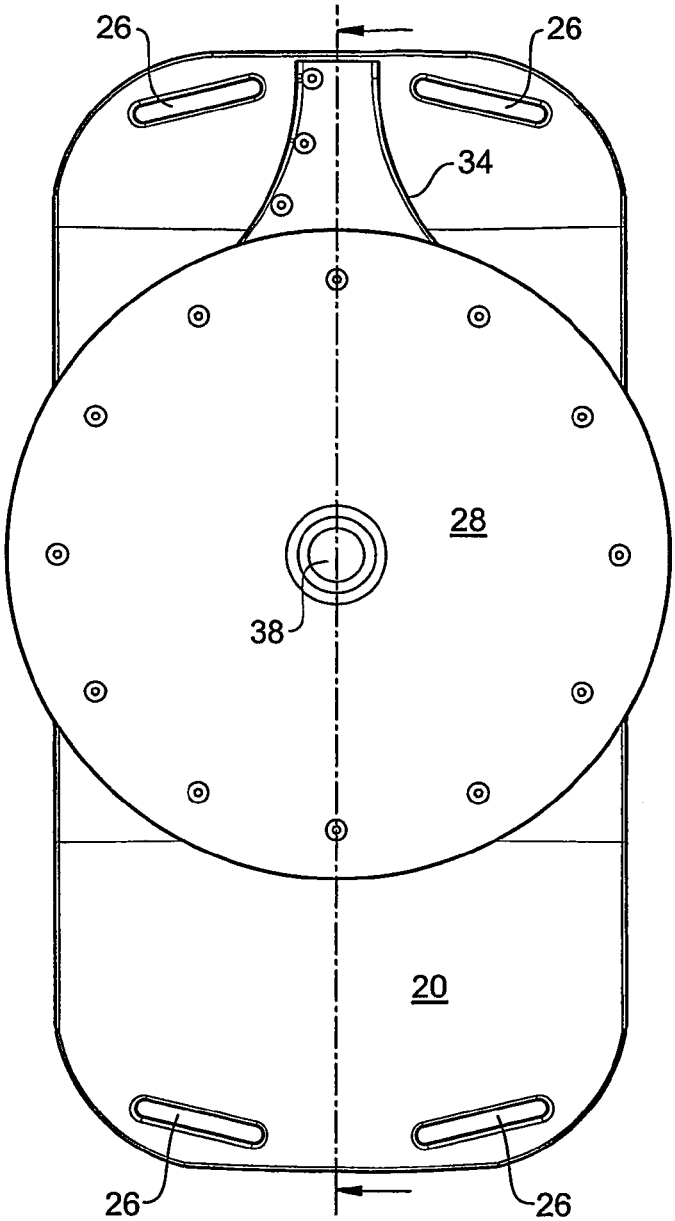
FIG. 3 shows a rear view of the full assembly of the device of FIG. 1.
Figure 4:
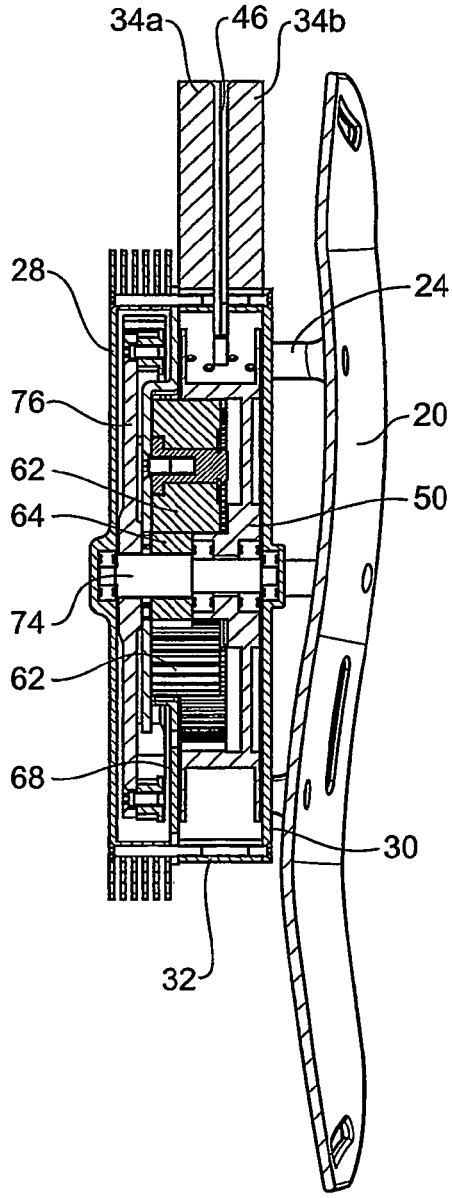
FIG. 4 illustrates an cross sectional side view of the assembly of FIG. 1.

An exterior view of the unit 10 can be seen in FIGS. 2 and 3 whilst FIG. 4 illustrates the same unit 10 in cross-section.

Figure 7:
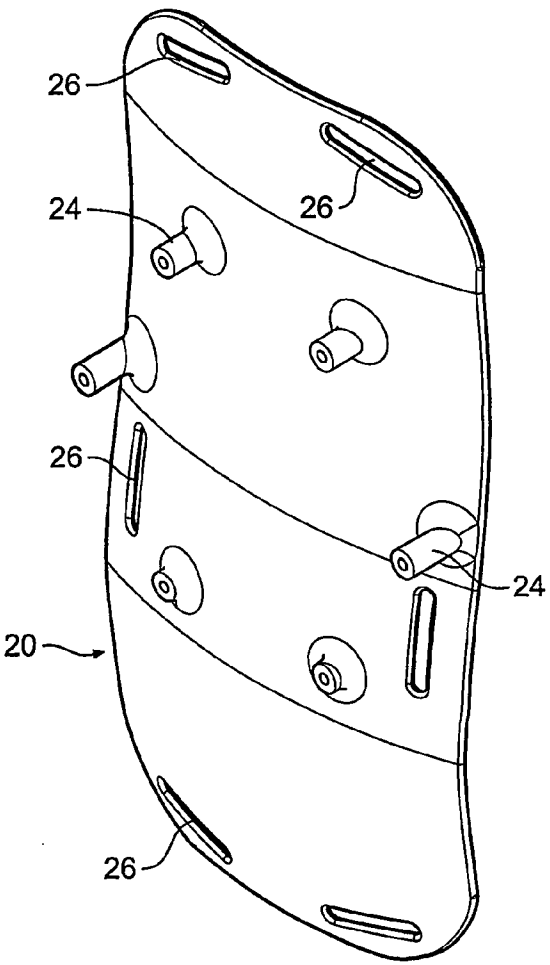
FIG. 7 shows a perspective view of a back plate used in the assembly of the device of FIG. 1.
Figure 6:
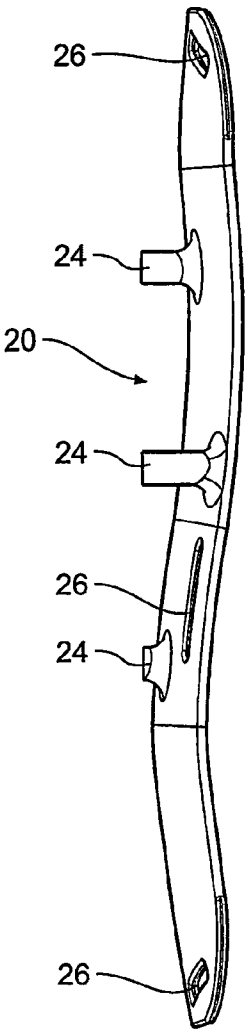
FIG. 6 shows a side view of a back plate used in the assembly of the device of FIG. 1.
Figure 5:
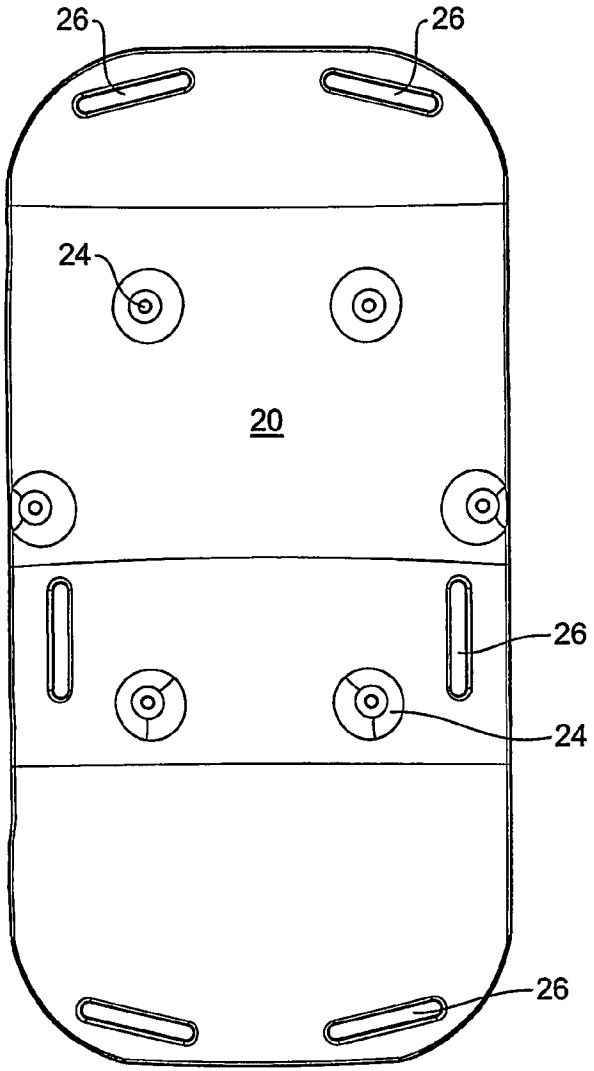
FIG. 5 shows a rear face view of a back plate used in the assembly of the device of FIG. 1.
Figure 8:
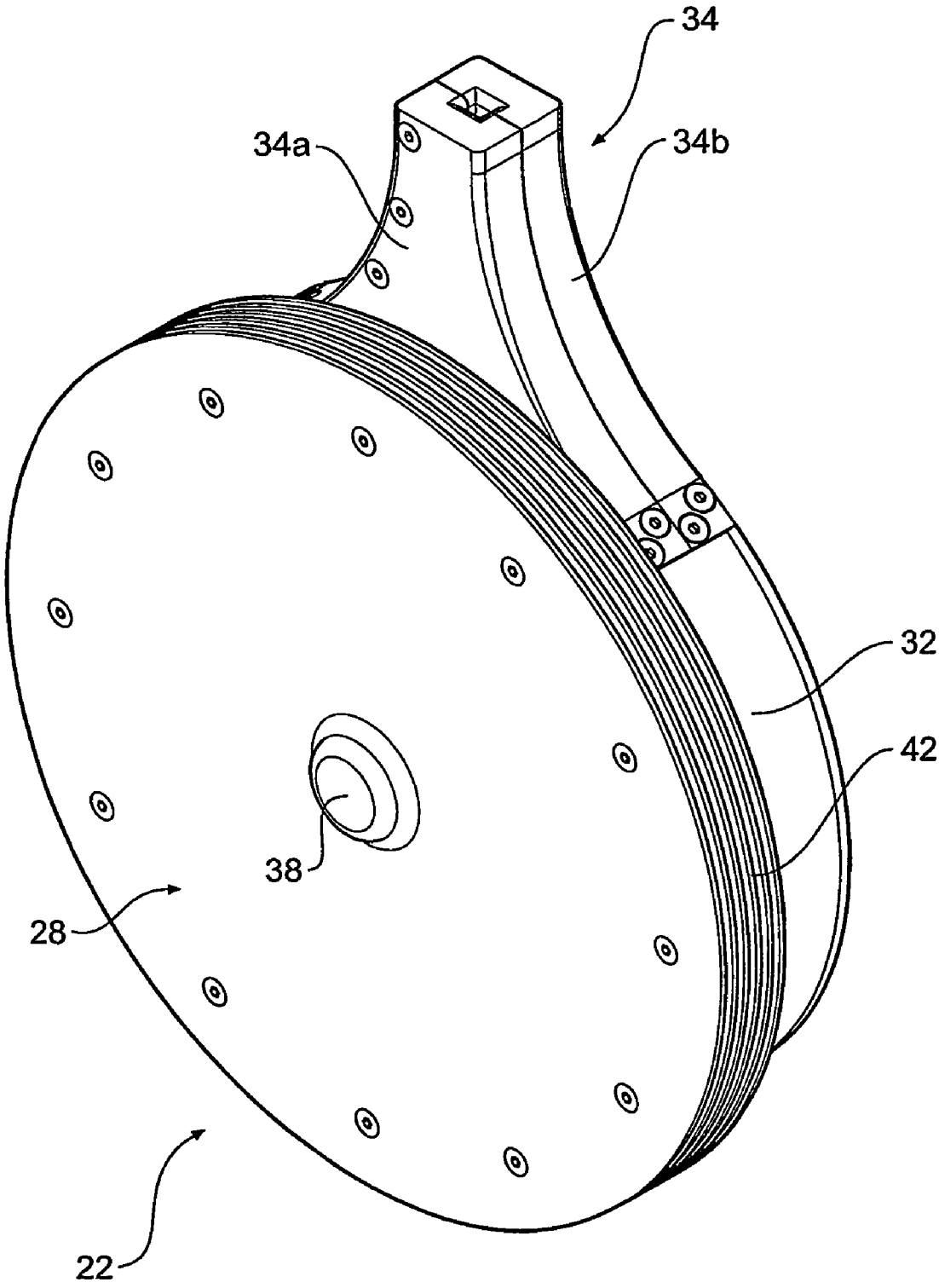
FIG. 8 illustrates a view of a main assembly of the device.

As can be seen, the unit 10 consists primarily of a back plate 20 which is individually illustrated in FIGS. 5,6 and 7, attached to which is a cable dispensing assembly 22. Raised mounting points 24 are used to secure the cable dispensing assembly 22 to the back plate 20. The connection means between each of the raised mounting points 24 and the back plate 20 are strong and capable of withstanding relatively heavy loads without fracture. The back plate 20 is a snug fit to the back of a user and from an inspection of FIGS. 2 to 7, it is apparent that the back plate 20 is moulded to take account of the contours of a body. A harness 25, shown only in FIG. 1, is attached to the back plate 20 through slots 26 and used to secure the unit 10 to the wearer 12 in known fashion. As may be appreciated, the harness 25 is suitable for rapid connection and is adjustable to fit persons of varying sizes.

The cable dispensing assembly 22, and components therein, are constructed substantially of aluminum and thus the unit 10 is overall a lightweight structure. It is to be understood that any material that possesses the same general properties as that of aluminum may also well be used. In preference, the connection means between raised mounting points 24 and back plate 20 is that of a standard weld.

Figure 9:
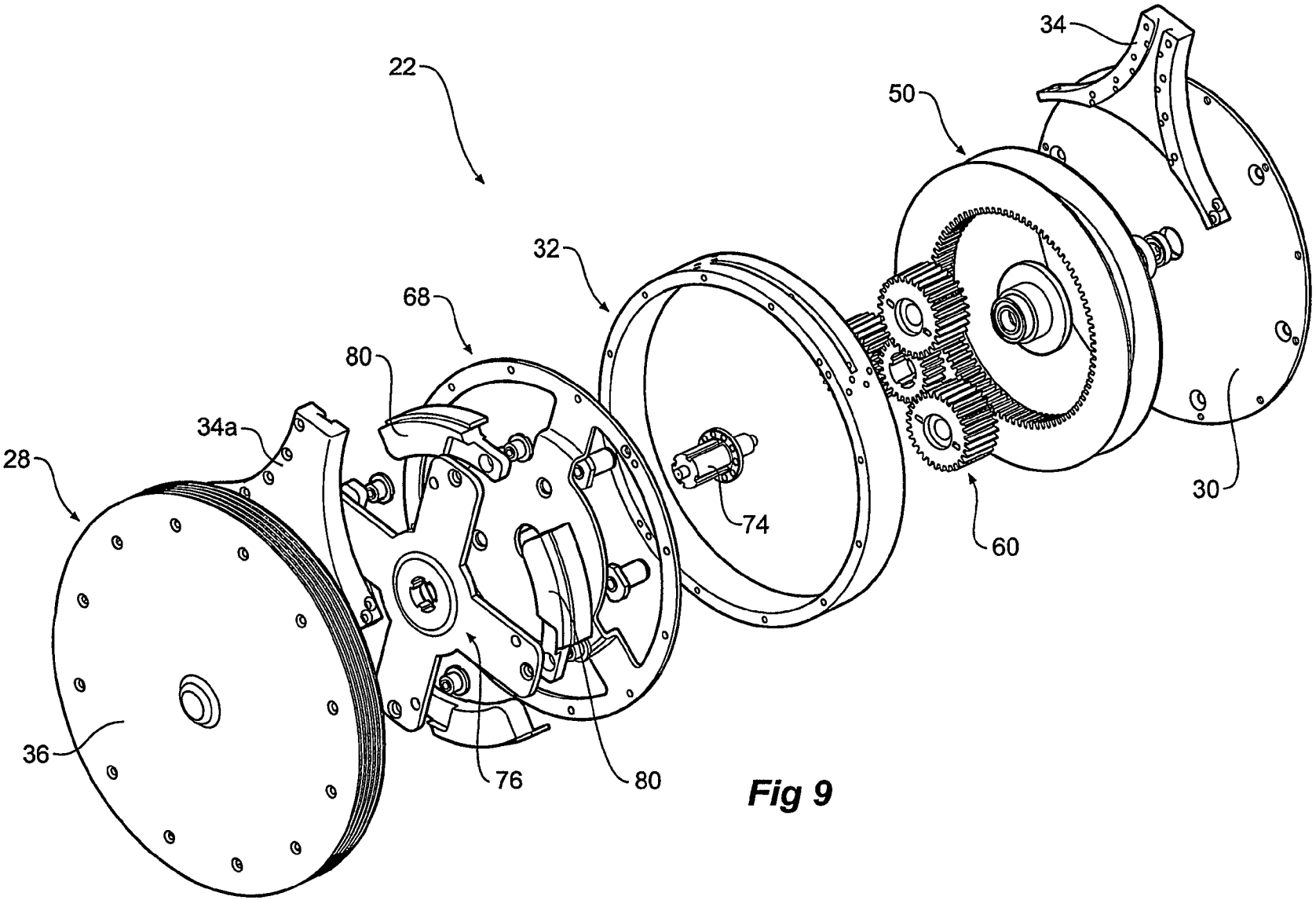
FIG. 9 shows the main assembly in exploded view.

Also visible from the exterior of the unit are the brake drum 28, main frame member 32, backing plate 30 and output guides 34, all of which can be clearly seen in FIG. 9. Taken together the brake drum 28, main frame member 32, and backing plate 30 form a housing for payout and braking mechanisms within the unit 10. As can be seen the housing elements are all generally circular and share common radial dimensions. Connecting screws, omitted from the drawings to allow greater clarity, are arranged circumferentially around the elements and connect the elements together to form the overall housing structure. In use, these components remain fixed and do not move.

FIG. 9 displays an exploded view of the cable dispensing assembly 22 which includes the abovementioned external features: the brake drum 28, main frame member 32, backing plate 30 and output guides 34; as well as internal features described herein below.

Figure 10:
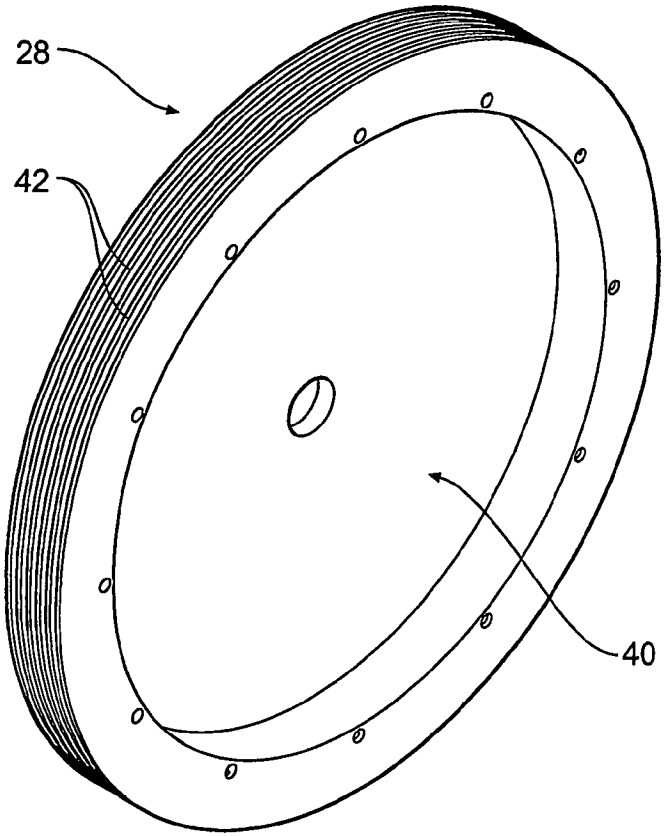
FIG. 10 shows the brake drum of the main assembly in various views.

The brake drum 28, as shown in FIG. 10 consists of a circular disc having an outer face 36 that forms an external face of the device 10 as seen in FIG. 2, for example. At the centre of the outer face 36 of the brake drum 28, the material surface is deflected outwardly forming a small hump 38. An inspection of the interior of the drum 28 reveals an inner recess 40 adapted to receive a brake spinner shaft (to be described). Located circumferentially on the brake drum 28 is a plurality of spaced apart leaf members 42. The leaf members 42 serve to cool the device 10 in operation. Each 'leaf' element 42 is separated by an air space. Thus, as the device 10 descends in use, airflow between adjacent leaf members 42 allows heat generated in the descent operation that has been transmitted to the leaf members 42 to dissipate from the device 10. No further cooling is regarded as necessary in the device. During operation the device 10 is thus self cooling and the as the speed of operation of the device increases, thereby increasing the speed of airflow across the drum 28 and the leaf members 42, the cooling effect thereof will proportionately increase.

Figure 11:
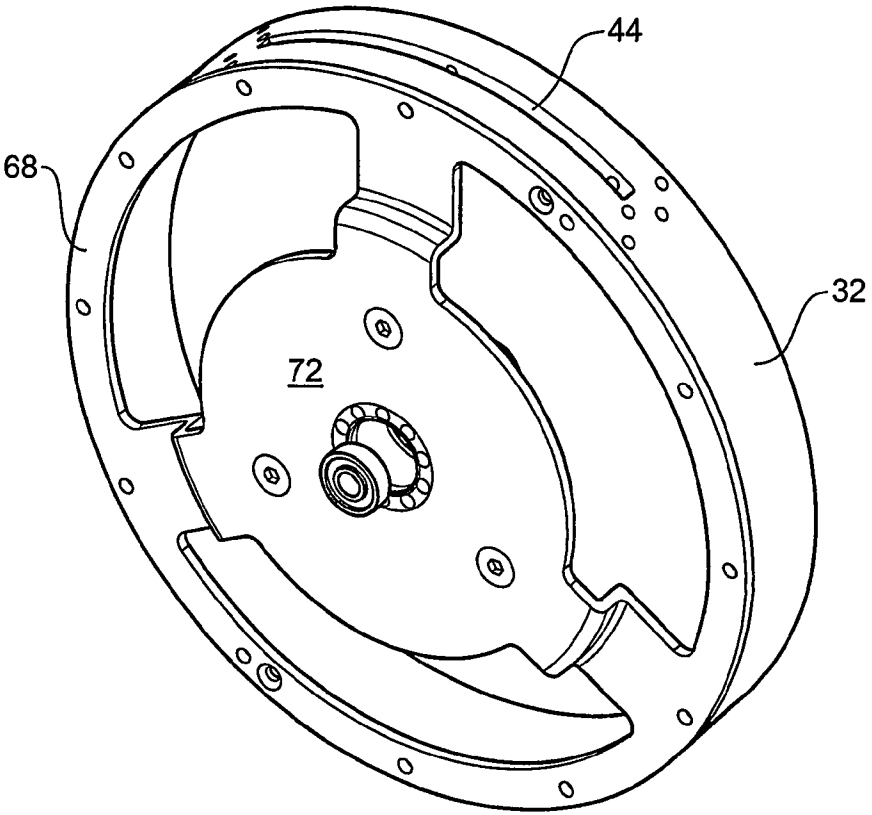
FIG. 11 shows the main frame of the main assembly in perspective view.
Figure 12:
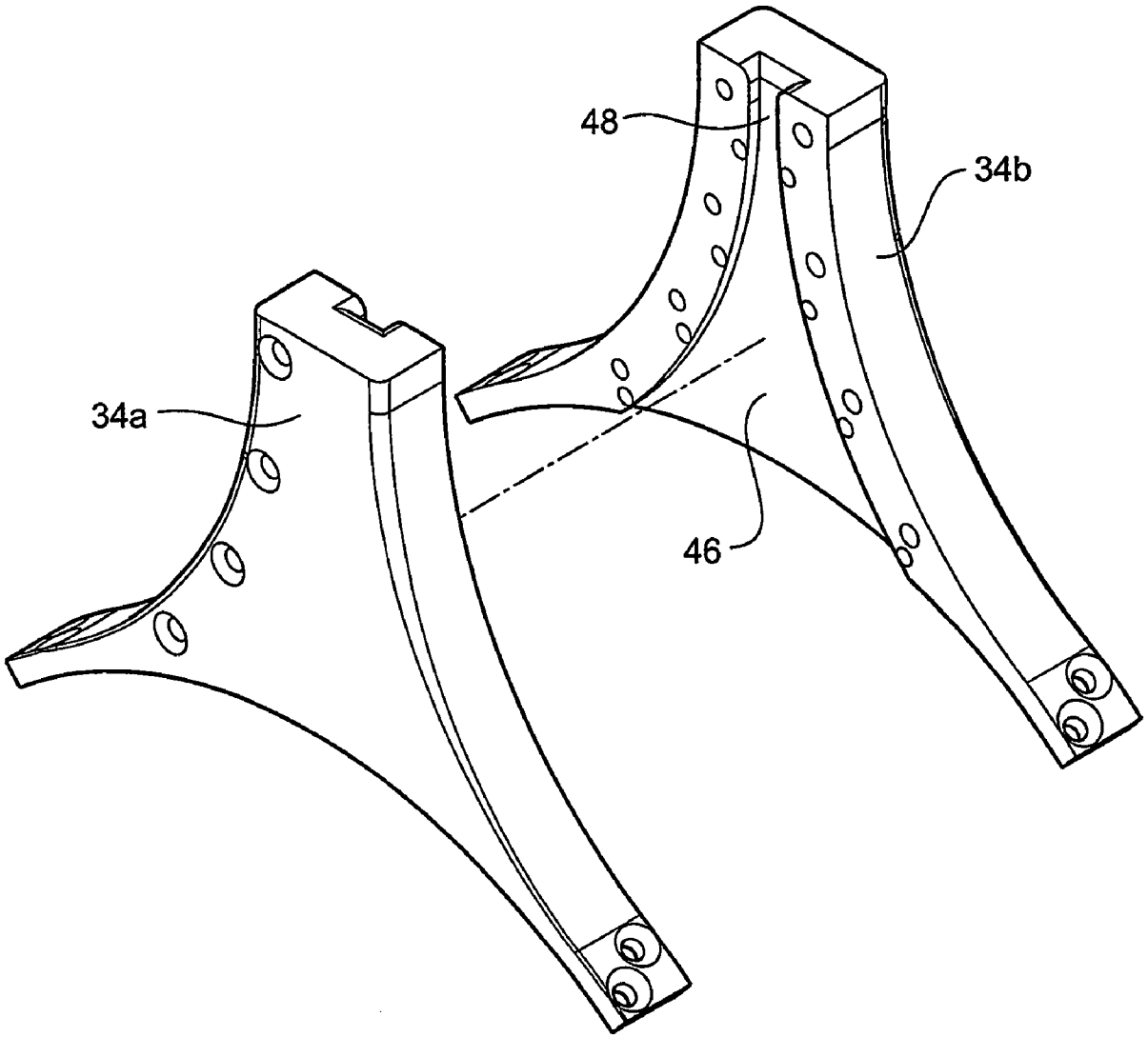
FIG. 12 illustrates output guides for use with the main assembly.

The main frame member 32 is essentially an open-ended cylinder as seen in FIGS. 9 and 11. The main frame member 32 is secured between the backing plate 30 and the brake drum 28 and thereby serves with those two units to define a spaced within which the remaining components are housed. Importantly, the wall of the main frame member 32 contains a circumferentially extending slot 44 over which the output guides 34 are mounted. The output guide 34, illustrated in FIG. 12 is formed of two separate halves 34*a*, 234*b* that together form an inverted funnel having a central channel 46 leading out of the slot 44. As shown in the drawings the channel 46 extends above the whole of the slot 44 and is generally planar. Edges of the channel 44 are curved to provide a smooth lead out for the cable 18 from the device 10. During use of the device 10, cable 18 held in the device is dispensed through the slot 44 and travels through the channel 46 in the output guide 34. The channel 46 narrows to a neck 48 that forms the terminal guide for the cable 18. The cable 18 is typically of sufficient breaking strength to hold any large adult as they travel under the influence of gravity though a distance of several hundred meters.

Figure 13B:
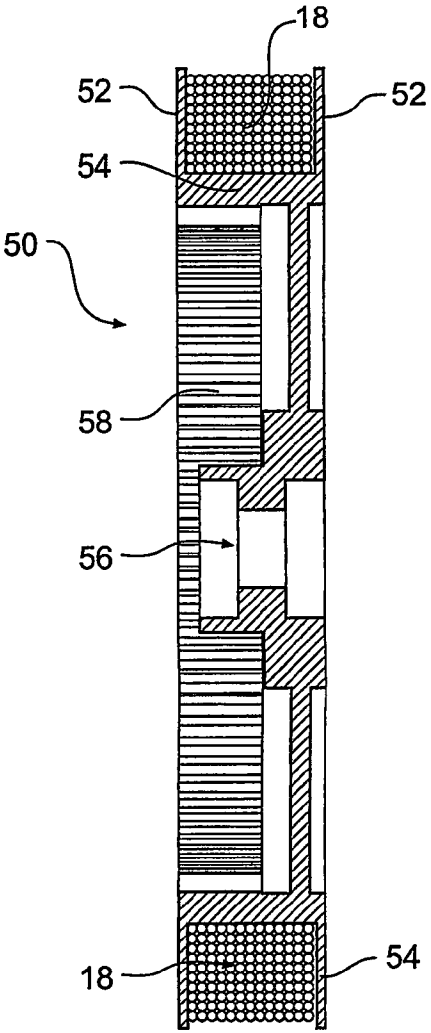
FIG. 13*b* shows the brake reel in side view.
Figure 13A:
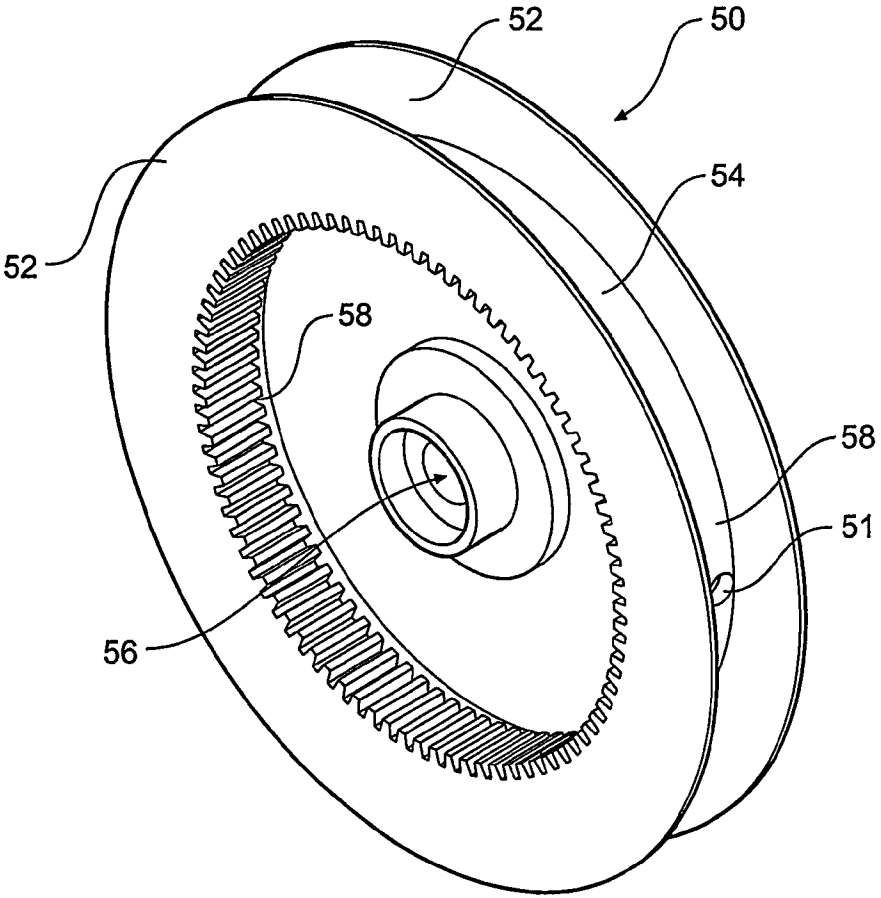
FIG. 13*a* illustrates a brake reel of the assembly in perspective view.

A reel 50 is used to hold and feed out the cable 18 during operation. As shown in FIG. 13 the reel 50 has side flanges 52 that serve to contain the cable 18 when wound on the reel and an inner wall 54. The side flanges 52 and wall 54 together contain and house the cable 18. The cable 18 is secured through an aperture 51 in an inner circular wall 58 of the reel 50 and a stopper (not shown) prevents the cable 18 from becoming loose and being pulled off the reel 50. The reel 50 is sized to fit neatly within the main frame 22. Further the reel 50 has a central aperture 56 within which is located the brake spinner shaft.

Within the reel 50, the inner surface of the wall 58 is notched and forms the ring gear of a planetary gear arrangement shown generally at 60. The planetary gear arrangement 60 is thus operatively connected to the cable feed out mechanism. In turn the planetary gear arrangement 60 is associated with a braking mechanism as described herein below. It should be noted that the reel 50, planetary gear arrangement 60 and braking mechanism are all arranged co-axially and are interconnected through their common axis in a manner that ensures that the operation of the breaking mechanism operates in response to the speed of the cable feed out from the reel 50.

Figure 14:
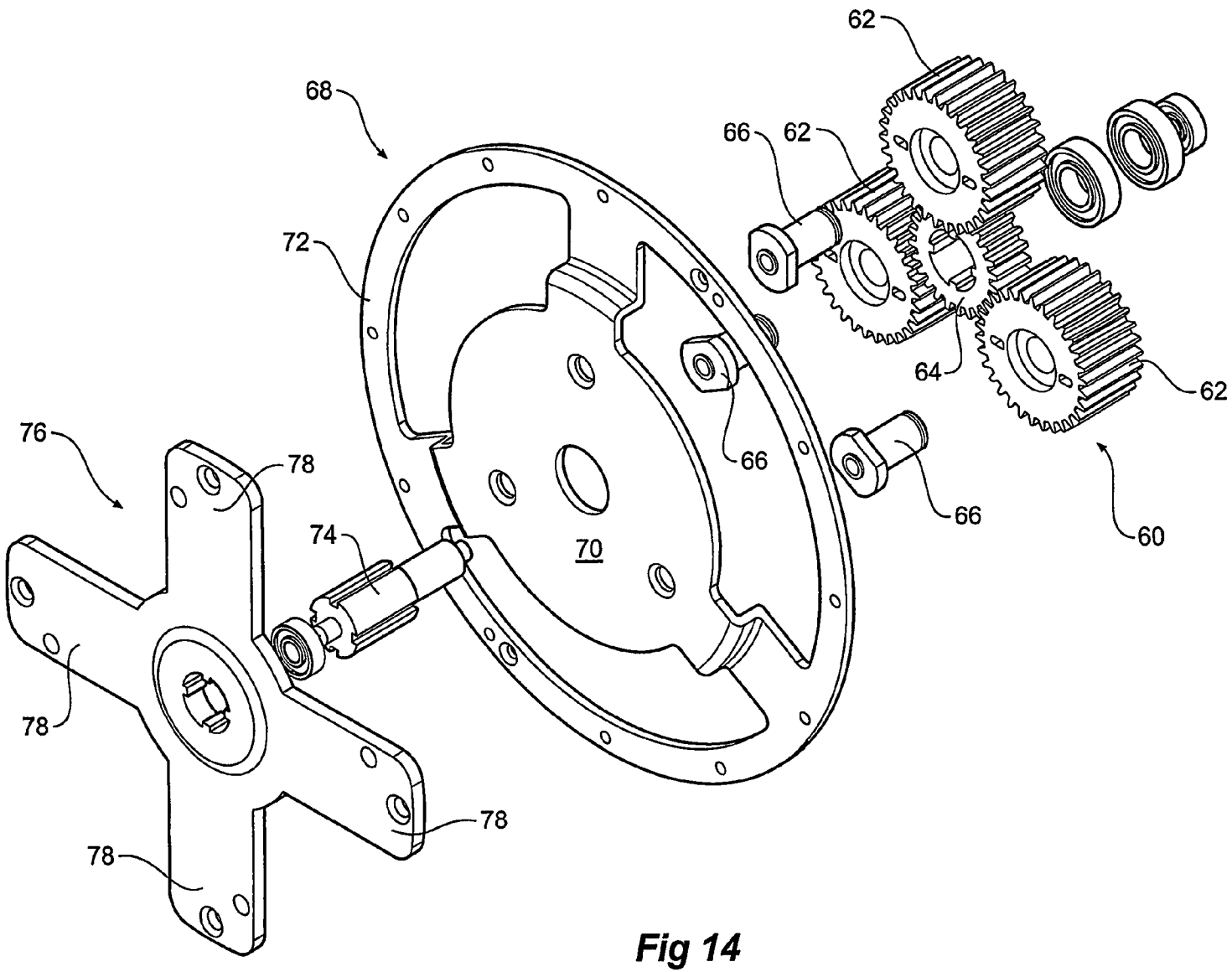
FIG. 14 is an exploded view of the brake gear assembly.
Figure 15:
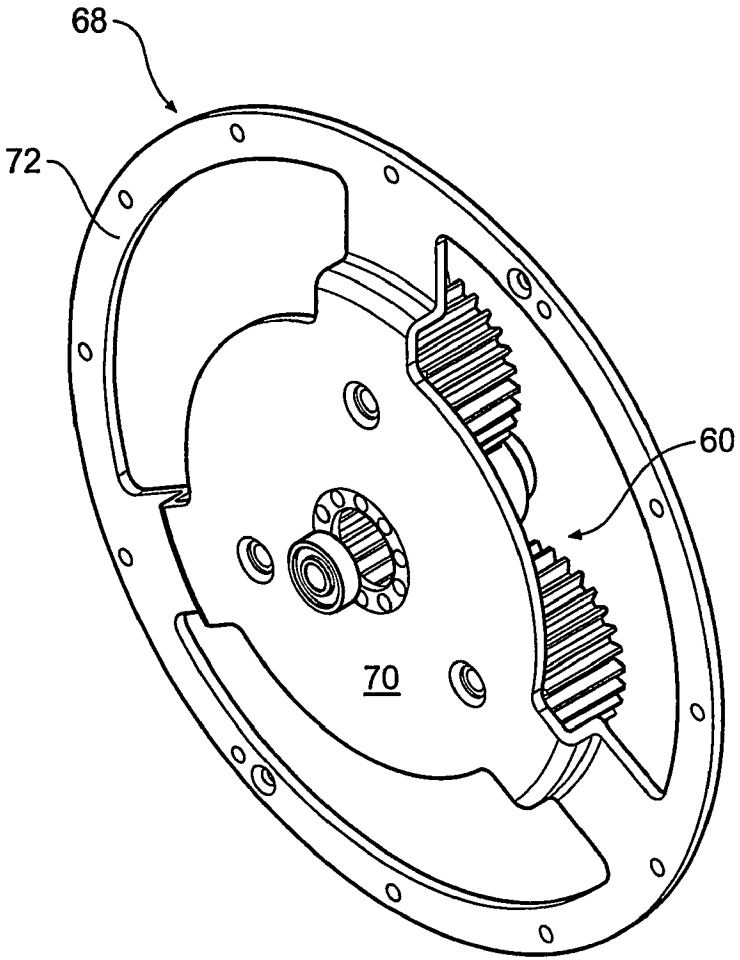
FIG. 15 depicts the brake gear assembly on the brake gear frame.

The planetary gear arrangement 60 is shown in detail in FIGS. 14 and 15. Individual components of the arrangement are also illustrated separately in the expanded view shown in FIG. 14 and the arrangement in assembled form in FIGS. 15 and 16. Some individual components of the arrangement are also illustrated separately. The planetary gear arrangement 60 consists of three outermost planetary gears 62 arranged around a central spinner gear (the sun gear) 64. The spinner gear 64 independently engages all three planetary gears 62. Further the planetary gears 62 each engage the notched inner wall 58 of the reel 50. The reel 50 thereby serves as a ring gear.

Figure 16:
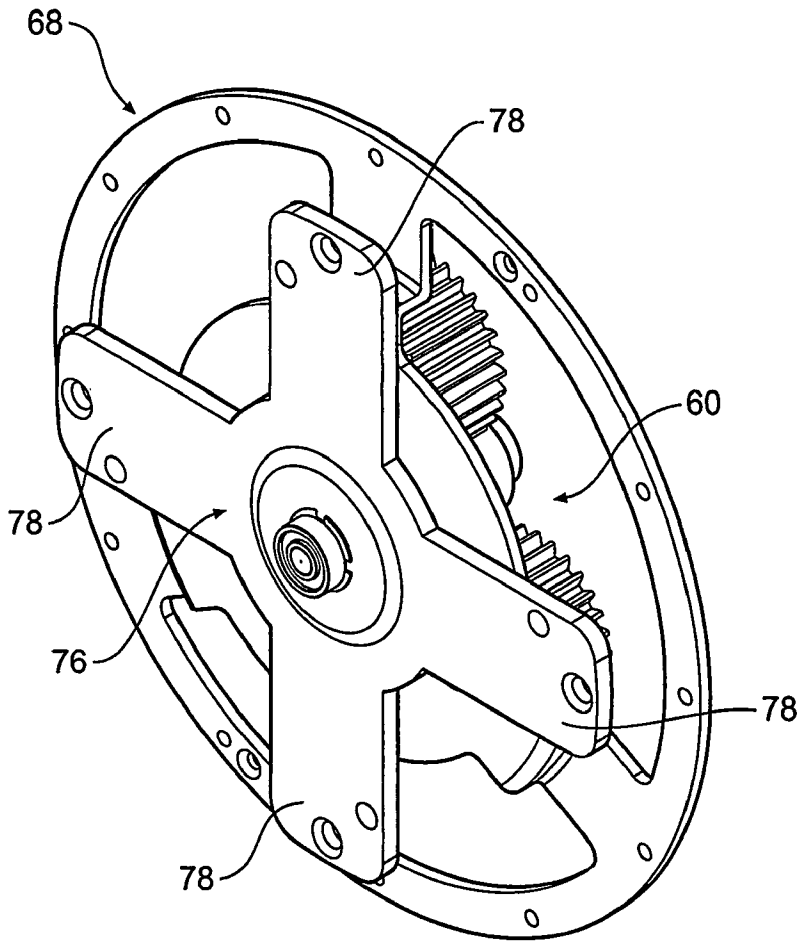
FIG. 16 depicts the brake gear assembly on the brake gear frame together with a brake spinner frame.

The planetary gears 62 are carried on a gear frame 68 shown in FIG. 16. A respective planetary gear shaft 66 is used to attach each planetary gear 62 to the gear frame 68. The gear frame 68 is a generally circular plate with a central saucer like recess 70 the recess 70 can be seen most clearly in side view in FIG. 14. The arrangement of the spinner gear 64 and surrounding planetary gears 62 locate snugly in the recess 70. The gear frame 68 is, in use, stationary and has an outermost rim 72 through which it is connected to the brake drum 28 and main frame 32.

The planetary gears 62 are driven in response to rotation of the reel 50 and in turn drive the spinner gear 64. It will be appreciated that the spinner gear 64 rotates at a multiple of the rotational speed of the reel 50, this being determined by the gearing ratio of the arrangement. In the embodiment under consideration the gear ratio is approximately 4:1.

The spinner gear 64 is located on a spinner gear shaft 74, shown in detail in FIG. 14. Interlocking axial elements on the spinner gear 64 and spinner gear shaft 74 secure the shaft for rotation with the gear 64. The spinner gear shaft 74 is also connected to a brake spinner frame 76 as shown in FIGS. 14 and 16. The assembly of planetary gears 62, gear frame 68 and brake spinner frame 76 is shown to advantage in FIG. 16. The spinner gear shaft 74 thus forms the important connection from the reel 50, through the planetary gear arrangement 60 to a braking mechanism.

Figure 17:
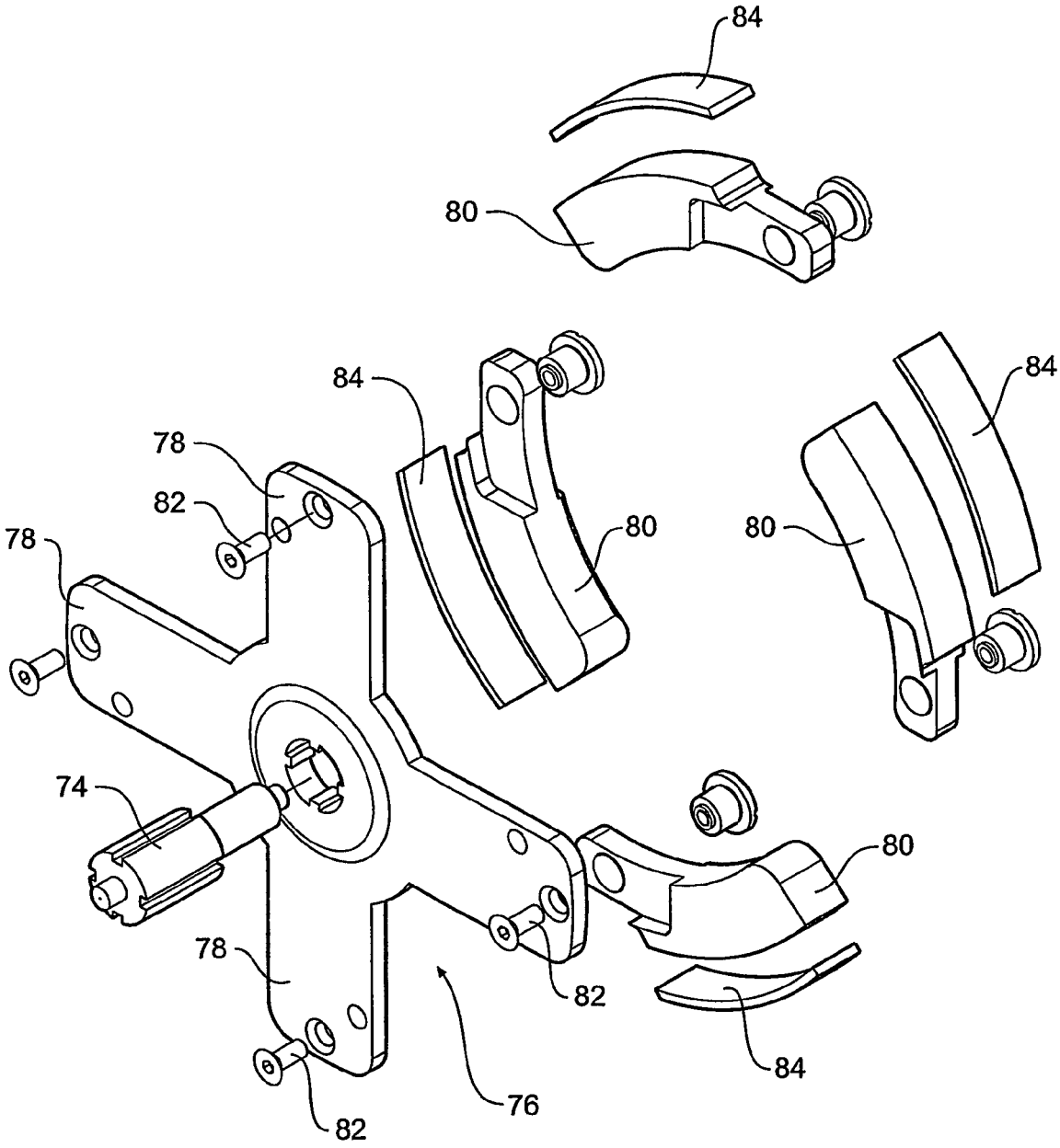
FIG. 17 illustrates in expanded form the brake sipper and brake arrangement of the assembly.
Figure 19:
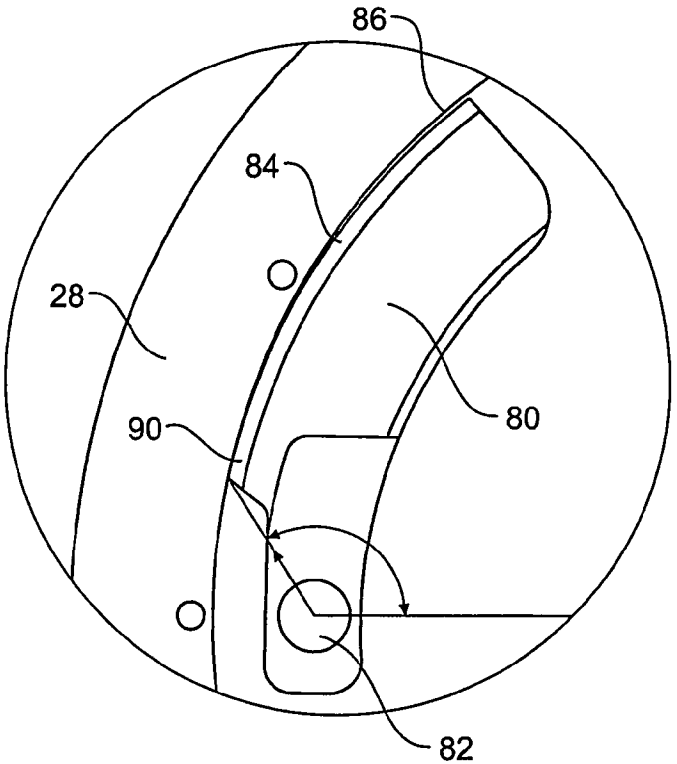
FIG. 19 shows a detail of FIG. 18.
Figure 18:
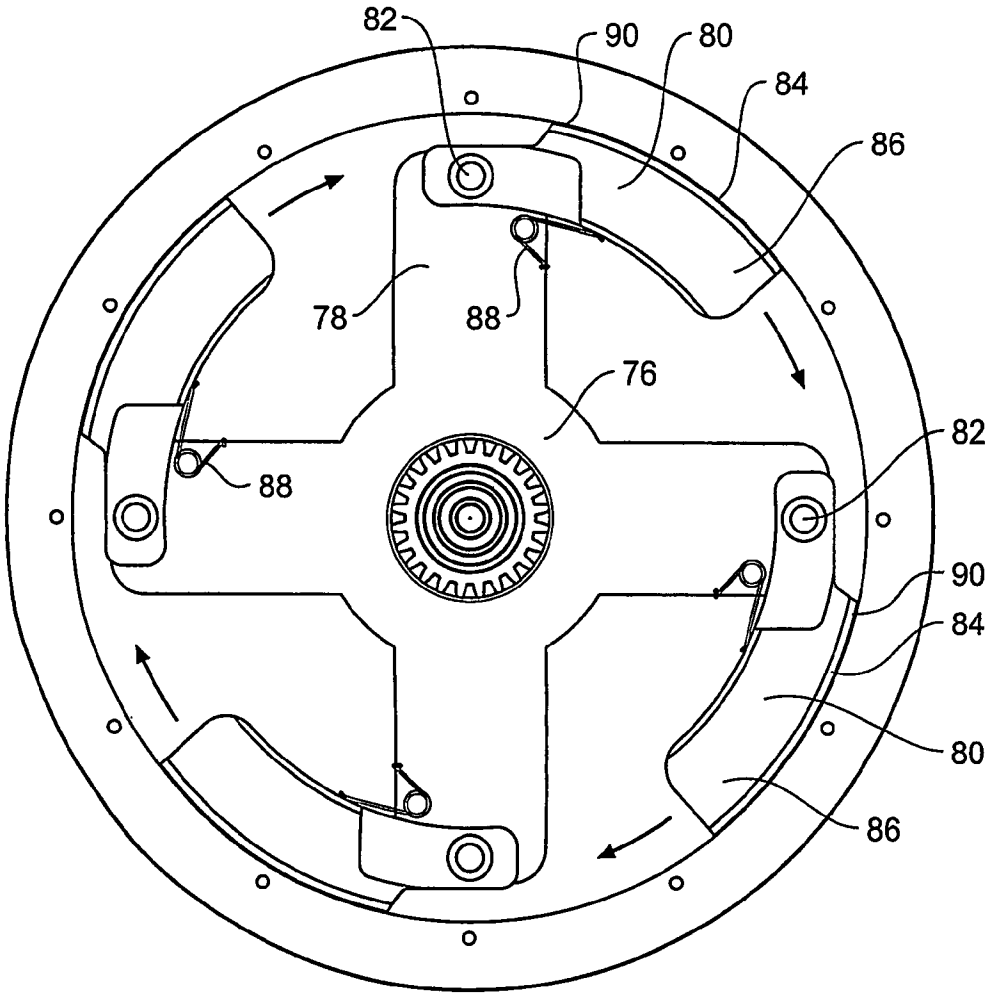
FIG. 18 shows the operation of the brake arrangement.

The brake mechanism can be seen in FIGS. 17-19 inclusive. The brake spinner frame 76 is a generally cruciform shaped plate having four arms 78 positioned at right-angles to one another. The spinner gear shaft 74 passes through the centre of the brake spinner frame 76 and interlocks with the brake spinner frame 76 so that as the spinner gear shaft 74 rotates the brake spinner frame 76 also rotates. It can also be seen that the brake spinner frame 76 moves without hindrance in a space between the brake drum 28 and the gear frame 68.

The arrangement of the braking system is shown in FIGS. 18 to 19. Positioned towards the outer edges of each arm 78 of the brake spinner frame 76 is a respective brake pad holder 80. The brake pad holders 80 are pivotally attached to the brake spinner frame arms 78 through pivot pins 82. A brake pad 84 is secured onto outer surface of each brake pad holder 80. As can be seen the pivot pins 82 attach the brake pad holders 80 to the brake spinner frame 76 at one end thereof leaving one end 86 of the brake pad in the brake pad holder free. In the orientation shown in FIGS. 18 and 19 the brake spinner frame 76 is rotated in a clockwise direction. Thus, the free end 86 of the brake pad holder 80 forms leading edge as the brake spinner frame 76 rotates and the pivot pins 82 are adjacent a trailing edge of the brake pad holder 80.

The illustration of the brake arrangement shown in FIGS. 18 and 19 is at rest, or in an unmoving position. Whilst at rest a biasing spring 88 biases the brake pad holder 80 into position such that a trailing edge of the brake pad 90—that is the end of the pad closest to the pivot pin 82, is biased against the inner surface of the brake drum 28 when there is no rotation of the brake spinner frame 76. The leading edge 86 of the brake pad holder 80 is left free, although, as can be seen from the detail of FIG. 19 the gap between the brake pad 84 and the brake drum 28 is in fact quite small. Because the trailing edge 90 of the brake is in contact with the brake drum 28 there is a small braking force at all times even when the device 10 is initialised and the speed of decent is very low. Thus, there is no requirement for the speed of the device to reach minimum speed before the braking mechanism will operate.

During operation the brake spinner frame 76 rotates at speed and the brake pad holders 80 are influenced by centrifugal forces. The brake pad holders 80 rotate about the pivot pins 82 thereby causing the curved outer surface of the brake pads 84 to progressively contact the surface of the brake drum 28. The brake therefore bites on the trailing edge 90 first and then as the forces increase the whole of the brake pad 84 is brought into engagement with the brake drum 28; the relative positions of the pivot pins 82 and the point of contact of the brake pad 84 and the brake drum 28 facilitate this action.

Thus, as the speed of the brake spinner frame 76 is increased, the centrifugal forces operating on the brake pad holders 80 is also increased, and the braking response, as a reflection of the contact are of the brake pad 84 to the brake drum 28, is also increased. Furthermore, it can also be understood that the braking response of the braking mechanism is proportional to the rate at which cable 18 is dispensed from the reel 50.

Figure 21:
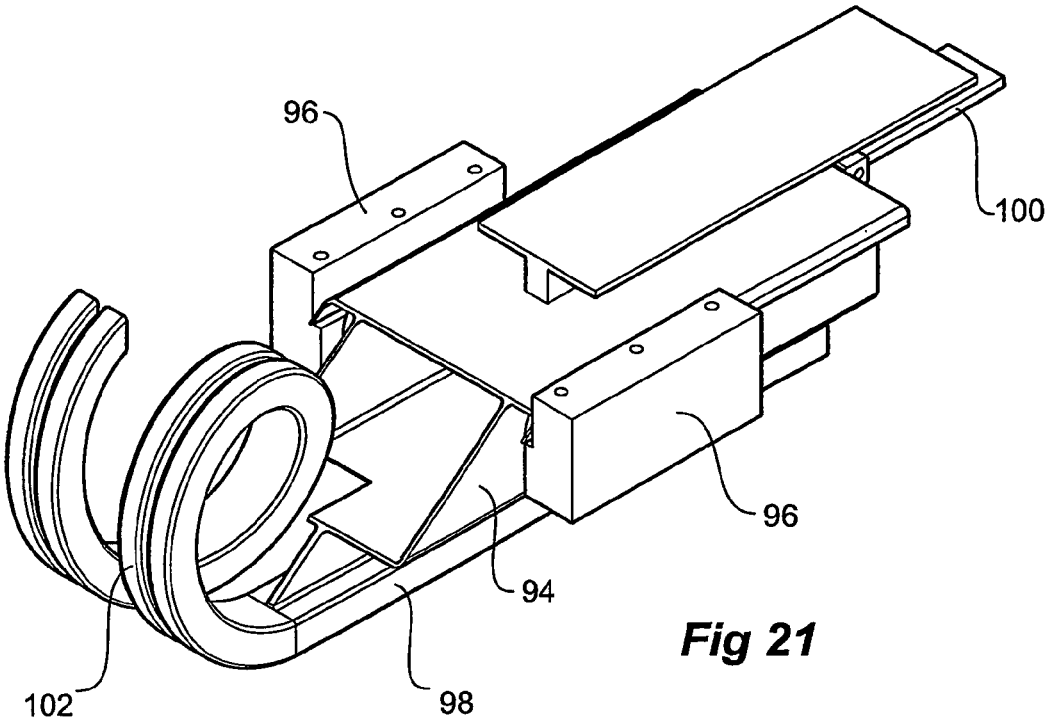
FIG. 21 represents a perspective view of a launch arm for use with the device of FIG. 1.
Figure 22:
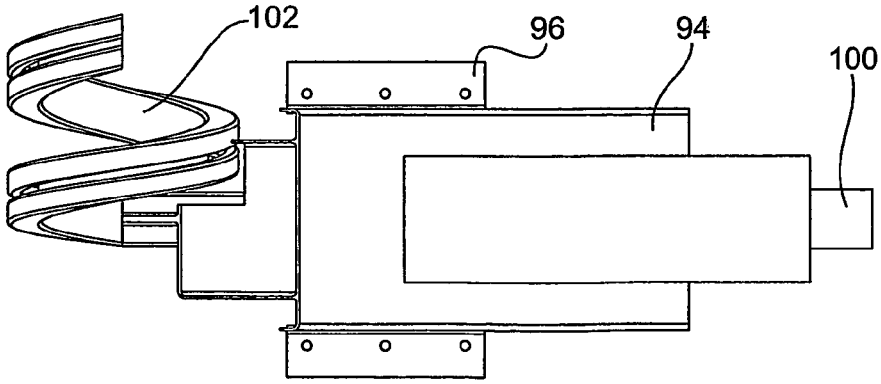
FIG. 22 shows a top view of the launch arm.
Figure 23:
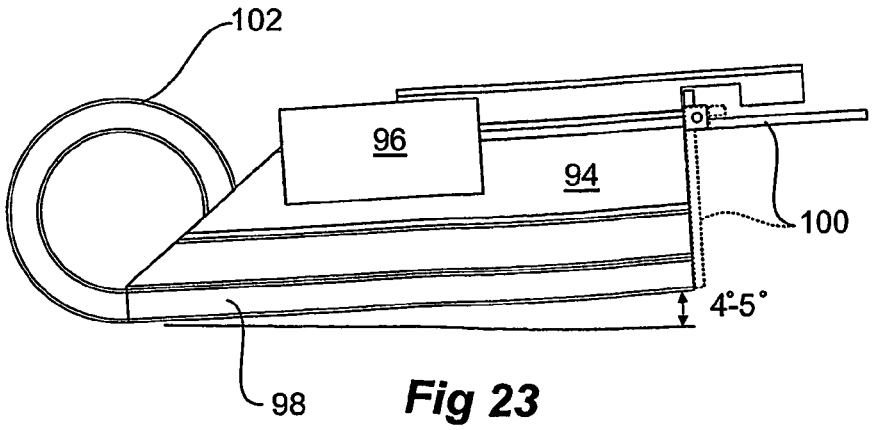
FIG. 23 illustrates in side view the launch arm.

In use therefore the device is assembled as described and as shown in the accompanying drawings. As seen in FIG. 2 the cable 18 terminates in a runner 92. In extreme situations the runner 92 may be attached to any convenient part of a building. However, in a preferred arrangement the building is modified to include a specific launch arm 16 as shown in FIGS. 21 to 23. The launch arm 16 is typically mounted to the ceiling of each level of a building at secure points, mounting blocks 96 are provided for this purpose. Within the mounting blocks 96 rests a hollow channel member 94.

The launch arm 16, thus consists of the hollow beam member 94 having on its underside an open track 98 of the type used in many sliding door assemblies. The launch arm 16 may be positioned to project from the side-wall of the building, or, alternatively can be constructed to be in a retracted condition and movable to an extended position as required. As shown in FIG. 23 the launch arm 16 is positioned so as to point downwardly at an angle of 4-5° from the horizontal. This incline of the launch arm promotes smooth running of the device in operation. A safety flap 100 restricts access to the track 98 until the launch arm 94 is in position for use. The safety flap 100 is spring biased into a closed position, thereby restricting access to the channel and track 98. As the channel is moved outwardly the flap 100 is released thereby opening the track 98 for access.

The runner 92 fits into the track 98 and is slideable along the track. It can be seen from FIG. 22 that the track 98 terminates in a curled ram's horn section 102. The ram's horn section allows a number of runners and attached cables 18 to be retained thereon during use. This permits a maximum speed of operation.

Thus, in use, a device 10 is attached to the track 98 by inserting the runner 92 into the track with the launch arm 94 in position. The device 10 is attached by harness to the back of an individual wearer. The wearer then escapes the building by descending on the cable 18. The reel 50 feeds out the cable 18 as the person descends thereby inducing the planetary gear arrangement 60 to rotate. In turn, the planetary gear arrangement 60 accelerates the spinner gear 64 a multiple of the speed of the rotation of the planetary gear arrangement 60. The spinner gear 60 drives a corresponding rotation in the gear frame 68 and, under the influence of centrifugal forces the brakes pads 84 are brought to bear against the brake drum 28 thereby serving to moderate the speed of descent. At some point the decent will reach a steady state where the accelerating influence of gravity and the braking effect are in equilibrium and the speed of decent becomes constant.

Figure 20:
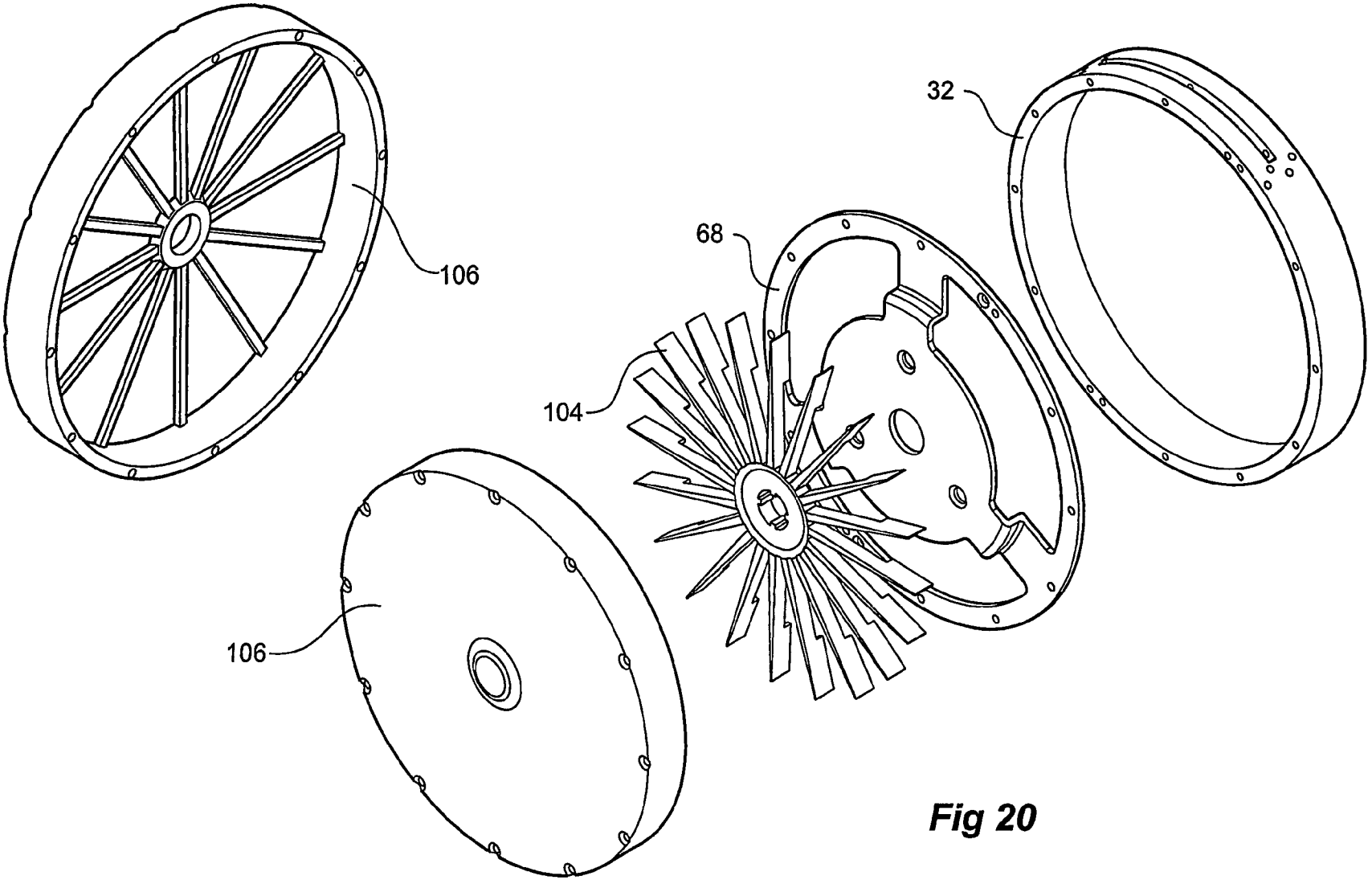
FIG. 20 shows schematically an alternative braking arrangement.

FIG. 20 illustrates an alternative form of braking arrangement. In the drawing within the space created by the main frame 32 turbulence fins 104 move through a fluid medium to slow the descent speed. The main frame 32 is in this case sealed by means of a sealing plate 106 and the body of the mainframe filled with a sealing fluid for example air or oil.

The invention has been described by way of example. The examples are not, however, to be taken as limiting the scope of the invention in any way. Modifications and variations of the invention such as would be apparent to a skilled addressee are deemed to be within the scope of the invention.

In any claims that follow and in the summary of the invention, except where the context requires otherwise due to express language or necessary implication, the word "comprising" is used in the sense of "including", i.e. The features specified may be associated with further features in various embodiments of the invention.

The invention claimed is:

1. An escape device comprising:

a cable;

a rotatable cable dispensing assembly from which said cable is dispensed under load;

a braking mechanism operatively connected to said rotatable cable dispensing assembly; and wherein said braking mechanism is a centrifugal braking mechanism in which a brake spinner frame having one or more braking elements attached thereto is operatively connected to the cable dispensing assembly, and wherein each of said braking elements has a first end and a second end; and the first end is pivotally mounted to said brake spinner frame and a spring element extends between the brake spinner frame and a region of the braking element proximate the first end thereof, and the first end of each of said braking elements is biased into contact with a braking surface and the second end thereof is spaced a distance from the braking surface when the braking mechanism is in a rest position; and said braking element pivots from the rest position into a braking position under the influence of centrifugal force as an output shaft rotates bringing the braking element progressively into contact with the braking surface with the second end of the braking element being brought into abutting contact with the braking surface; whereby a braking response of the braking mechanism is proportional to the rate at which cable is dispensed from the rotatable cable dispensing assembly.

2. An escape device according to claim 1, further comprising an outer housing having said cable dispensing assembly and said braking mechanism located therein.

3. An escape device according to claim 2, wherein said outer housing includes cooling leaf members adapted to allow air flow therethrough to thereby dissipate any heat generated by said device.

4. An escape device according to claim 3, wherein said outer housing includes guides to locate the position of the cable dispensed from said device.

5. An escape device according to claim 1, further comprising a back plate mounted thereto, wherein said back plate is adapted to be strapped to a back of a person to thereby secure said person to said device.

6. An escape device according to claim 1, wherein the braking mechanism is operatively connected to said cable dispensing assembly through the output shaft driven by the cable dispensing assembly and wherein said brake spinner frame having one or more braking elements attached thereto is connected to the output shaft and is rotated in response to rotation of the output shaft.

7. An escape device according to claim 1, wherein said braking mechanism is operatively connected to said cable dispensing assembly through a geared arrangement.

8. An escape device according to claim 7, wherein said rotatable cable dispensing assembly includes a reel from which said cable is dispensed, said reel having an innermost surface which serves as a ring gear of a planetary gear mechanism and wherein said ring gear operates through the planetary gear mechanism to drive the output shaft, said output shaft serving to operate said braking mechanism.

9. An escape device according to claim 8, wherein the planetary gear mechanism consists of three outermost planetary gears carried on a stationary gear frame and arranged around a central spinner gear and wherein the spinner gear independently engages all three planetary gears, whereby each planetary gear engages the ring gear such that dispensing of cable drives the ring gear which, in turn, drives the planetary gears and thus the spinner gear.

10. An escape device according to claim 9, wherein the spinner gear is secured for rotation on a spinner gear shaft, and wherein the spinner gear shaft is also connected to the braking mechanism such that the speed of rotation of the spinner gear and thereby the speed of rotation of the braking mechanism is proportional to the speed of rotation of the ring gear and thus the braking response of the braking mechanism is proportional to the rate at which cable is dispensed from the cable dispensing assembly.

11. An escape device according to claim 1, wherein said cable is adapted to be connected at a free end thereof to a launch arm attached to a building.

12. An escape device according to claim 11, wherein the launch arm includes a channel member having a track therein adapted to hold a runner attached to the free end of the cable.

13. An escape device according to claim 12, wherein said launch arm is movable between a retracted position in which the channel member is inoperative and an extended position in which the launch arm is available for use; said launch arm including a safety flap serving to restrict access to said channel member when the launch arm is in the retracted position and said safety flap being released as said launch arm is moved to the extended position thereby permitting access to said channel member.

14. An escape device comprising:

a housing having a front wall, a back wall, and a perimeter wall extending between the front and back walls;

a back plate connected to the back wall of the housing; said back plate including a plurality of straps extending outwardly away from a surface thereof remote from the housing's back wall;

a cable dispensing assembly retained within the housing; said cable dispensing assembly comprising a reel operatively connected to a shaft that extends between the front and back walls of the housing; and wherein rotation of the dispensing assembly causes rotation in the shaft;

a cable having a first end secured to the reel and a second end that extends outwardly from the housing and includes an attachment means adapted to secure the cable to a fixed object;

a braking mechanism retained within the housing, said mechanism comprising a brake spinner frame operatively connected to the shaft, one or more braking elements attached to the spinner frame, each of the braking elements having a first end and a second end; where the first end is pivotally mounted to the spinner frame and a spring element extends between the spinner frame and a region of the braking element proximate the first end thereof, and the first end of each of said braking elements is thereby biased into contact with a braking surface; and the second end thereof is spaced a distance from the braking surface when the braking mechanism is in a rest position and said braking element pivots from the rest position into a braking position under the influence of centrifugal force as the shaft rotates bringing the braking element progressively into contact with the braking surface, with the second end of the braking element being brought into abutting contact with the braking surface; whereby a braking response of the braking mechanism is proportional to the rate at which the cable is dispensed from the rotatable cable dispensing assembly; and a planetary gear mechanism is disposed intermediate the dispensing assembly and the braking mechanism, wherein an interior surface of the reel of the dispensing assembly serves as a ring gear for the planetary gear mechanism and the shaft is operatively connected to a sun gear thereof.

15. The escape device as defined in claim 14, wherein the back plate is contoured to fit a human back and at least some of the straps are adapted to be received over the shoulders of a user.

16. The escape device as defined in claim 14, wherein the housing further includes a cable guide that extends upwardly and outwardly from the perimeter wall of the housing, and the cable guide includes a channel through which the cable is dispensed.

17. The escape device as defined in claim 14, wherein the housing further includes a plurality of cooling leafs that extend outwardly from the perimeter wall of the housing.

18. The combination as defined in claim 14, wherein the launch arm has a first end that is fixedly secured to the building and a second end that is remote therefrom and spaced a distance outwardly away from the side wall of the building and wherein the launch arm angles downwardly from the first end thereof to the second end thereof at an angle of between 4-5° from the horizontal.

19. In combination:

an escape device comprising:

a rotatable cable dispensing assembly;

a cable having a first and a second end; where the first end is attached to a spool housed within the dispensing assembly and said cable is dispensable from the assembly under load;

a runner attached to the second end of the cable;

a centrifugal braking mechanism operatively connected to the spool; said mechanism including a brake spinner frame having one or more braking elements attached thereto, each of said braking elements having a first end and a second end; and the first end is pivotally mounted to said brake spinner frame and a spring element extends between the brake spinner frame and a region of the braking element proximate the first end thereof, and the first end of each of said braking elements is biased into contact with a braking surface and the second end thereof is spaced a distance from the braking surface when the braking mechanism is in a rest position; and said braking element pivots from the rest position into a braking position under the influence of centrifugal force as an output shaft rotates bringing the braking element progressively into contact with the braking surface, with the second end of the braking element being brought into abutting contact with the braking surface; whereby a braking response of the braking mechanism is proportional to the rate at which cable is dispensed from the rotatable cable dispensing assembly; and a launch arm adapted to be fixedly secured to a building such that the launch arm extends outwardly beyond a side wall of the building; wherein the launch arm includes a channel member having a track therein and the runner on the second end of the cable is engageable in the track and is movable therealong.

* * * * *